US005566725A

United States Patent [19]

Jaeger

[11] Patent Number: 5,566,725

[45] Date of Patent: Oct. 22, 1996

[54] WEFT CLAMP CONTROLLER FOR A WEFT GRIPPER IN A SHUTTLELESS LOOM

[75] Inventor: Siegfried Jaeger, Lindau, Germany

[73] Assignee: Lindauer Dornier Gesellschaft mbH, Lindau, Germany

[21] Appl. No.: 429,537

[22] Filed: Apr. 26, 1995

[30] Foreign Application Priority Data

May 5, 1994 [DE] Germany ..... 44 15 862.9

[51] Int. Cl.[6] ..... D03D 47/12

[52] U.S. Cl. ..... 139/446

[58] Field of Search ..... 139/446, 444, 139/445

[56] References Cited

U.S. PATENT DOCUMENTS

| | | | |
|---|---|---|---|
| 3,438,402 | 4/1969 | Kokkinis | 139/446 |
| 3,665,975 | 5/1972 | Kokkinis | 139/446 |
| 4,384,598 | 5/1983 | Haussler | 139/446 |
| 4,558,722 | 12/1985 | Gehring et al. . | |
| 5,303,747 | 4/1994 | Arndt et al. | 139/446 X |

*Primary Examiner*—Andy Falik
*Attorney, Agent, or Firm*—W. G. Fasse; W. F. Fasse

[57] ABSTRACT

A weft clamp (8) of a gripper head in a shuttleless loom is operated by a finger (10) driven by a coupling rod (13) which in turn is activated by a cam drive (18; 30, 31). The finger is mounted to the upper end of the coupling rod which is guided by a rocker arm (24) that follows the reed or sley motion. The lower end of the coupling rod is directly coupled through a cam follower roller (17) to the cam drive (18; 30, 31), either by one or more springs that assure a continuous engagement of the cam follower roller with the cam or by a bellcrank lever that engages a double cam with two rollers, one at each end of the two bellcrank arms. In both instances only one pivot or journal is needed in the transmission link for the actuating force for operating the clamp operating finger (10) in synchronism with the sley oscillating movement and in synchronism with the gripper movement.

12 Claims, 3 Drawing Sheets

WEFT CLAMP CONTROLLER FOR A WEFT GRIPPER IN A SHUTTLELESS LOOM

FIELD OF THE INVENTION

The invention relates to an apparatus for controlling the operation of a weft thread clamp on a weft gripper in a shuttleless loom.

BACKGROUND INFORMATION

German Patent Publication 3,320,200 (Gehring et al.), corresponding to U.S. Pat. No. 4,558,722 (Gehring et al.), issued on Dec. 17, 1985 discloses an apparatus for the constrained actuation of the clamping system of weft yarn inserting members in shuttleless weaving looms. In such a loom an inserting gripper transports the weft thread to the center of a loom shed where a second gripper, while the loom shed is open, receives the leading end of the weft thread being inserted and pulls it entirely through the shed to the exit side. Thereafter, the beat-up motion by the reed is performed. The reed is connected to the sley that oscillates about its central longitudinal axis driven by the main loom drive shaft for the beat-up motion. The mechanism for controlling the weft clamp on the respective gripper head comprises a control lever or finger that controls the weft clamp. The control lever in turn is connected to one end of a coupling rod that is mounted for a longitudinal motion and for a tilting motion. The other end of the coupling rod is pivoted to a rocker arm or control lever which in turn carries a cam follower roller engaging a control cam driven by a drive shaft which in turn is driven in synchronism with the sley shaft. For transmitting the force of the control cam onto the rocker arm and from the rocker arm onto the coupling rod for the opening of the weft clamp, the entire transmission link or train comprises a plurality of pivot or journal connections in which a certain bearing play exists that cannot be avoided. It is in the nature of such connecting links that the just mentioned play increases with time. This fact is aggravated because the total play of the transmission link results from the sum of the individual plays at all connecting pivots or journals. Thus, the total play tends to become with time an undesirable play because it may interfere with the precise timing of the activation of the weft clamp in synchronism with the gripper movements. Besides, the weft clamp may become worn out before its time. Thus, there is room for improvement.

OBJECTS OF THE INVENTION

In view of the above it is the aim of the invention to achieve the following objects singly or in combination:

to provide an operating and control mechanism for the weft clamp of a gripper head in which the above mentioned wear and tear is reduced by reducing the number of journals or pivots in the force transmission train between the drive cam and the clamp control finger;

to minimize or avoid altogether the use of springs that keep the cam follower in contact with the drive cam;

to substantially increase the useful life of the control mechanism for the weft clamp of a gripper head; and to reduce or eliminate down times of the loom caused by repairs due to worn out parts, broken springs that conventionally formed part of the control linkage.

SUMMARY OF THE INVENTION

The present weft clamp controller for a weft gripper in a shuttleless loom having a sley carrying a reed and a sley shaft connected to said sley for performing a beat-up motion, is characterized by the following combination of features. A weft clamp operating finger is driven by a drive cam through a coupling link or rod connected with its upper end to the finger and cooperating with its lower end with a drive cam. A rocking guide arm guides the upper end of the coupling link, whereby a first pivot connects the guide arm to said coupling link below the finger. A second pivot connects the guide arm to said sley for movement with said sley. Just one cam follower roller is rotatably connected by a single journal to said lower end of said coupling link for a direct engagement of cam follower roller with drive cam surface. An urging mechanism for constantly urging the cam follower roller into engagement with said drive cam is connected to be effective on the cam follower roller. A drive shaft drives the drive cam in synchronism with said sley shaft.

According to a first embodiment of the invention the urging mechanism comprises a roller guide lever pivoted by the single journal to the cam follower roller and to the coupling link, wherein a further journal pivots or journals the roller guide lever to said loom frame, and at least one spring is so positioned that it urges or biases the cam follower roller constantly against the drive cam in any position of the coupling link or rod.

According to a second embodiment of the invention the urging mechanism comprises a bellcrank lever having a first lever arm and a second lever arm, a bellcrank journal pivoting said bellcrank lever to the loom frame, where the single journal pivots the cam follower roller to the first lever arm of the bellcrank and to the lower end of the coupling link. A further cam follower roller is pivoted to the second lever arm of the bellcrank lever, whereby the drive cam engages the cam follower roller and the further cam follower roller so that the bellcrank lever urges both rollers into engagement with said drive cam, by reason of a fixed spacing between the bellcrank journal and the drive shaft that drives the cam.

In one embodiment of the invention only a single pivot or journal is needed in the force transmission link between the cam follower and the weft clamp control lever. Hence, the play has been substantially reduced and practically a play-free force transmission has been achieved. This substantially increases the useful life of the control mechanism and of the weft clamp itself.

In the second embodiment of the invention, any type of cam and follower engagement maintaining spring has been avoided because the cam follower cannot disengage from the control or drive cam due to the operation of a bellcrank lever that engages the drive cam like a clamp. The elimination of a spring or springs in the control train has a substantial advantage because spring breakage is eliminated and hence loom down times for the repair of broken springs are avoided.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
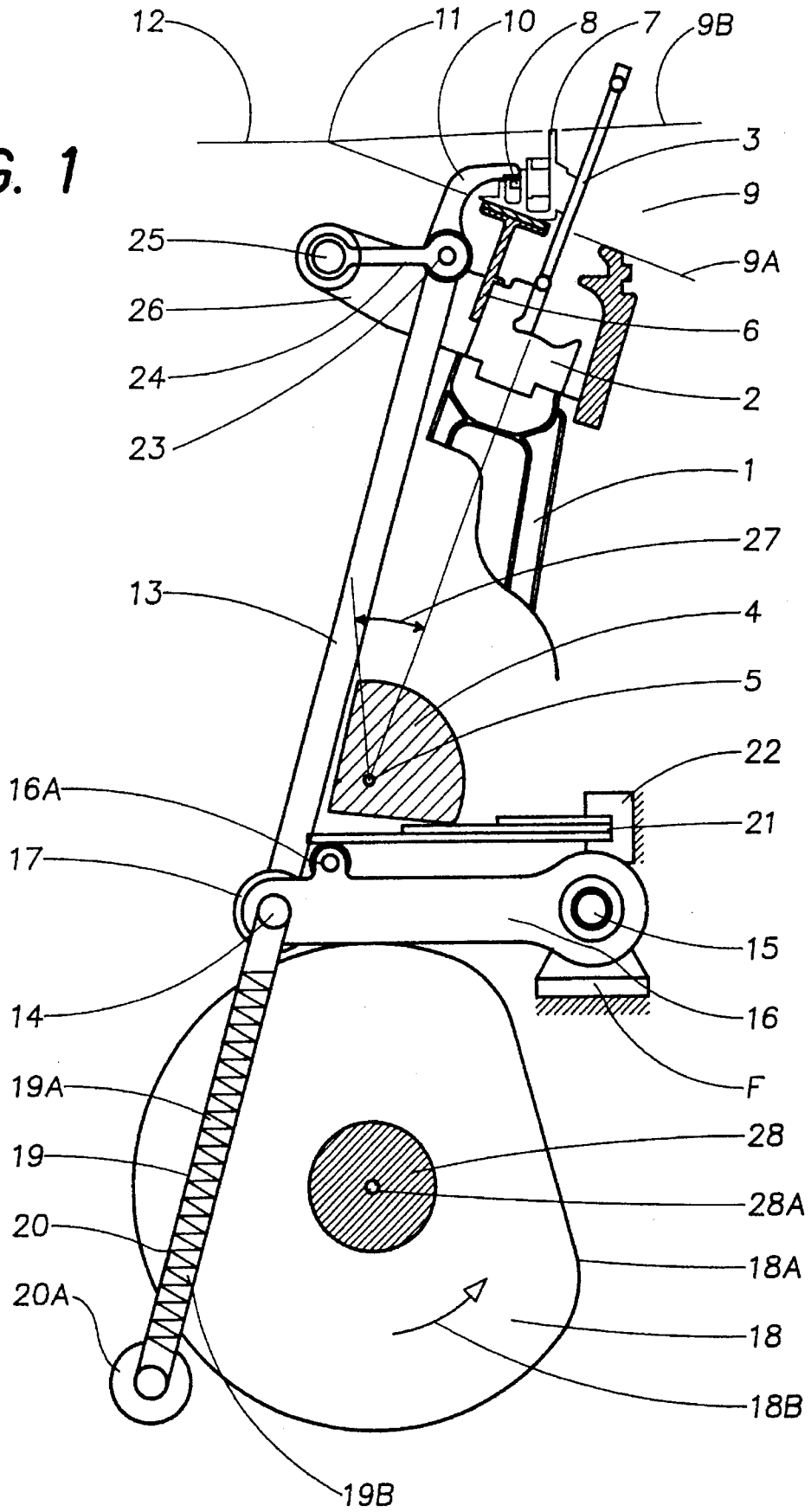
FIG. 1 shows a first embodiment of a weft clamp control linkage according to the invention in a position in which the clamp control finger engages the weft clamp.

FIG. 1 shows a loom sley 1 with a reed stay 2 carrying a reed 3. The sley 1 is mounted for oscillation about the central longitudinal axis 5 of a sley shaft 4. A sley cap 6 having a T-cross-sectional configuration is secured to the reed stay 2. A gripper head 7 slides back and forth on the sley cap 6 in a direction perpendicularly to the plane of the drawing for inserting a weft thread into the loom shed. A withdrawing gripper head takes over the weft thread in the middle of the loom shed and pulls the weft thread entirely through the loom shed. Each of these gripper heads is equipped with a weft clamp 8 which must be operated at the precise moment of the transfer from one head to the other. For this purpose a control finger 10 is controlled to move through the lower shed warp threads 9A of the shed 9 and out again. The lower shed warp threads 9A and the upper shed warp threads 9B form a beat-up line 11 for the formation of the fabric 12.

The control finger 10 is rigidly secured to the upper free end of a coupling rod 13. The lower end of the coupling rod 13 is connected through a journal shaft 14 to the free end of a cam follower lever 16, whereby the journal shaft 14 also carries a cam follower roller 17 engaging a control or drive cam 18. The other end of the cam follower lever 16 is journalled by a journal 15 to the machine frame F. The cam follower roller 17 is freely rotatable about its journal shaft 14 at the free end of the lever 16.

The just described construction and mounting of the coupling rod 13 according to the invention thus requires only a single journal 14 in the force transmission link that operates the clamp control finger 10. This single journal in the transmission link is the journal 14. A further pivot 23 is not counted in this respect because the pivot 23 links the rod 13 to a rocking guide arm 24 which in turn is journalled by a journal 25 to a bracket 26 secured to the reed stay 2. The further pivot 23 does not participate in the transmission of the operating force to the finger 10 because it merely guides the motion of the coupling rod or link 13 in synchronism with the sley motion driven by the sley shaft 4.

Figure 2:
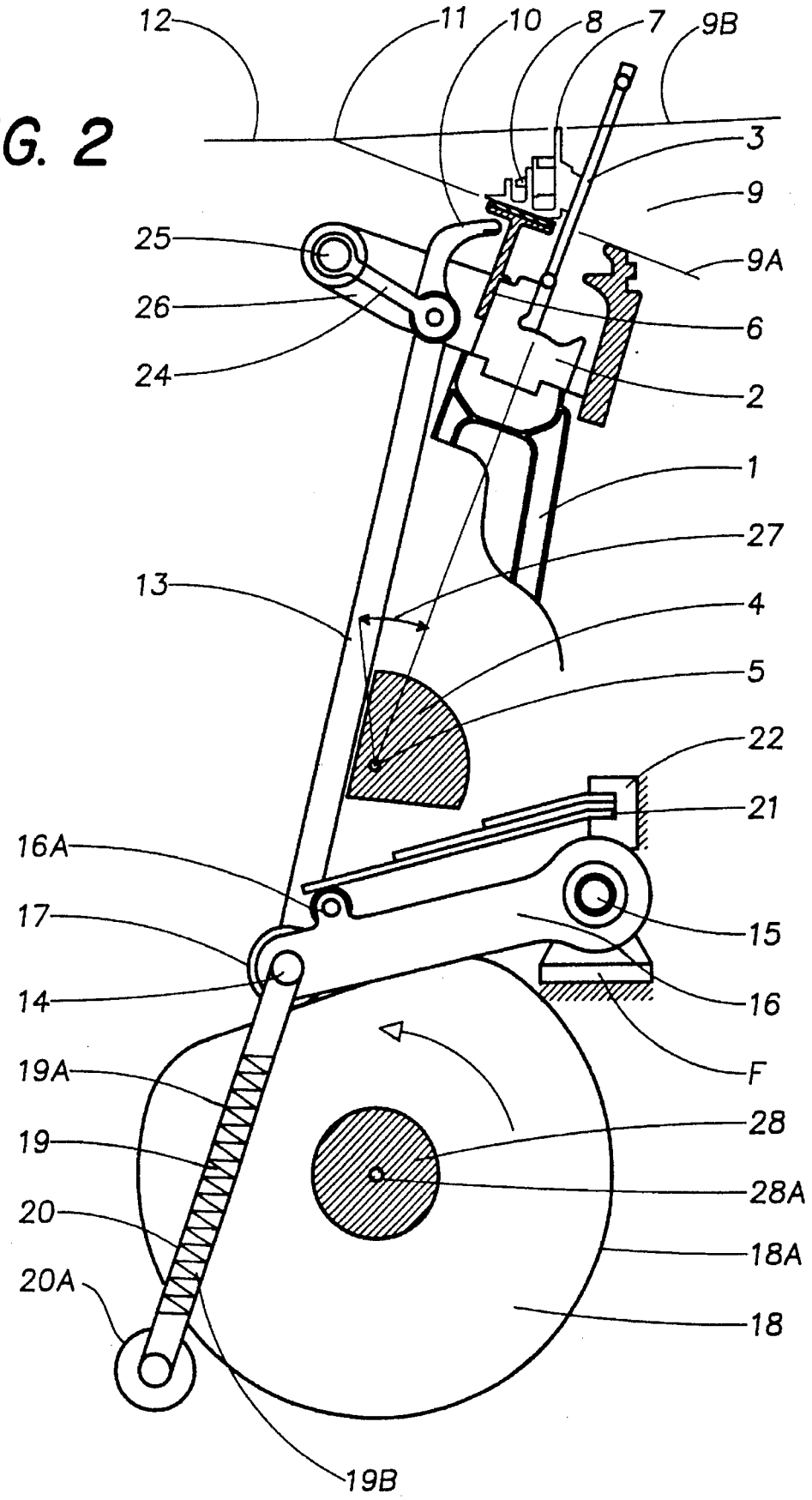
FIG. 2 is a view as in FIG. 1, however, illustrating the disengagement of the clamp control finger from the weft clamp.

At least one spring 20 mounted on two telescoping spring guide members 19A and 19B is so arranged that an effective biasing force is applied to the cam follower roller 17 preferably in the direction of the axis 19 in substantial axial alignment with the longitudinal axis of the coupling rod 13 to keep the cam follower roller 17 in engagement with the cam surface 18A of the drive cam 18 which rotates counterclockwise as indicated by the arrow 18B in FIG. 1 and is driven in synchronism with the sley shaft 4 by the main drive shaft of the loom. The free end of the spring guide member 19B is journalled by a journal 20A to the machine frame. In the position of FIG. 1 the spring 20 is expanded. In the position of FIG. 2 the spring 20 is contracted. In both instances the roller 17 is pulled to the surface 18A of the cam 18. It has been found that an optimal effectiveness of the spring 20 is achieved if it is assured that the axis 19 on which the force of the spring 20 is effected forms substantially an extension of the longitudinal motion direction of the coupling rod 13.

In addition to or instead of the spring 20 a leaf spring packet 21 may be provided for continuously keeping the cam follower roller 17 in engagement with the cam surface 18A of the drive cam 18. The leaf spring packet 21 engages with its free end a member 16A of the cam follower lever 16. The member 16A is preferably a roller. However, the free end of the spring packet 21 may also directly engage the roller 17 to press the roller 17 downwardly against the drive cam 18. The right-hand end of the leaf spring packet 21 is connected to a clamping element 22 that is rigidly, but preferably adjustably, secured to the loom frame F.

The above described rocking guide arm 24 links the coupling rod 13 through the journal 25 and through the bracket 26 to the slay 1 so that the coupling rod 13 follows in its motion the movement of the sley 1 and reed 3 in synchronism therewith as indicated by the double arrow 27 in response to the drive of the sley shaft 4 which in turn is operated in synchronism with the rotation of the cam 18 driven by the cam shaft 28. The cam follower lever 16 and the coupling rod 13 with its control finger 10 perform a combined translational rotational motion for contacting the weft clamp 8 of the gripper head 7 in synchronism with the gripper movement. This combined translational and rotational movement depends on the curvature of the cam surface or curve 18A of the drive cam 18 and on the fixed position of the journal 15.

Figure 3:
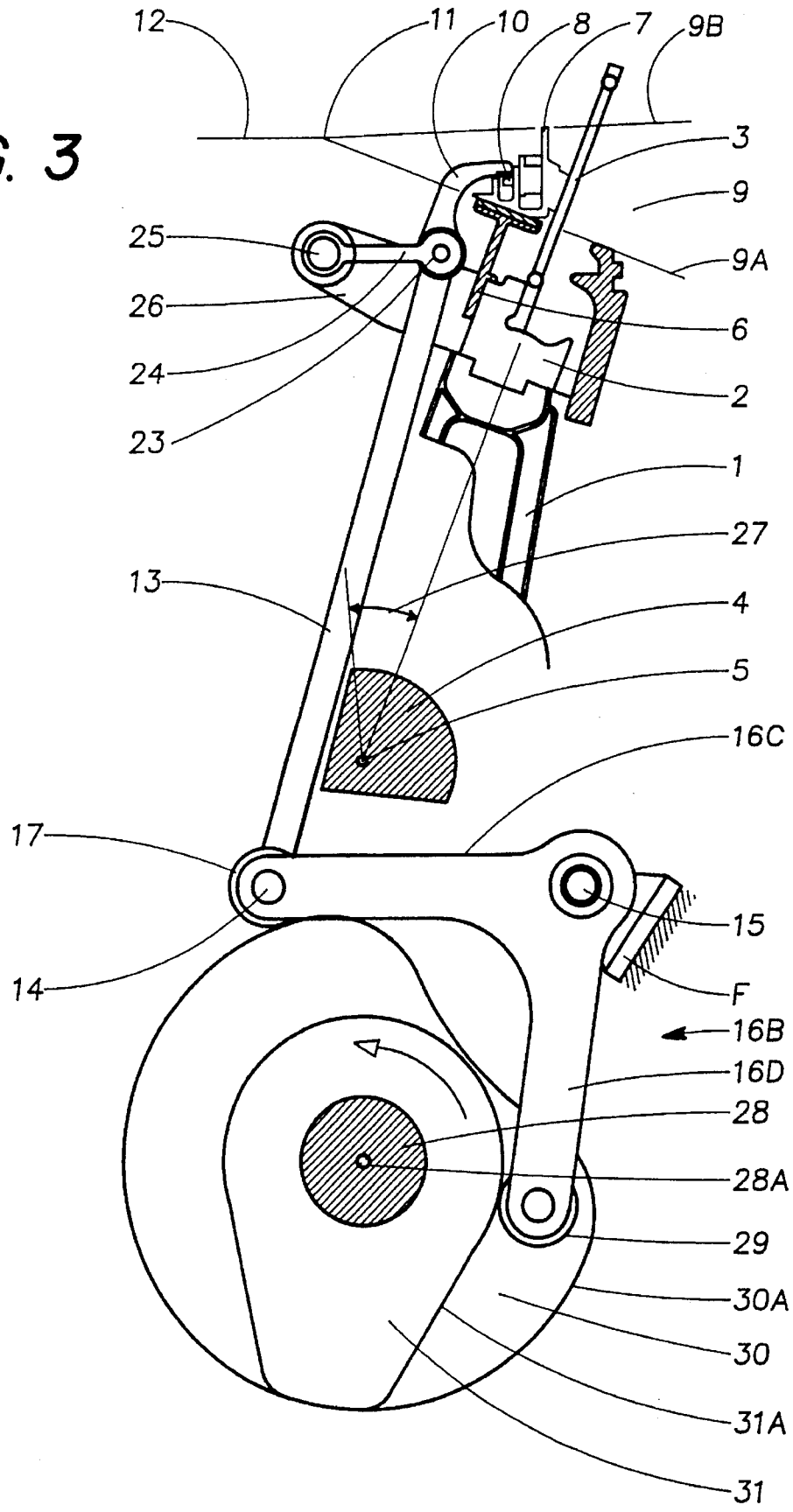
FIG. 3 shows a view similar to that of FIG. 1, however, illustrating a second embodiment of the present weft clamp control without any springs for keeping a cam follower engaged with its control cam.

As mentioned FIG. 1 and also FIG. 3 show the active engagement of the finger 10 with the weft clamp 8 while FIG. 2 shows the out-of-the way or passive position of the finger 10.

FIG. 3 shows an embodiment without cam engagement urging biasing springs. Components in FIG. 3 that are the same as in FIG. 1 and 2 are provided with the same reference numbers. The cam follower lever 16 of the first embodiment has been replaced by a bellcrank lever 16B having two arms 16C and 16D. The arm 16C carries the same roller 17 as in the first embodiment. The arm 16D carries at its free end an engagement urging guide roller 29. The rollers 17 and 29 preferably engage different cam surfaces 30A and 31A of the twin drive cam 30 and 31. Both cams are rigidly mounted on the drive shaft 28 for rotation about the rotational axis 28A in synchronism with the sley motion. The cam follower roller 17 engages the cam surface or curve 30A while the cam follower roller 29 engages the cam surface or curve 31A of the drive cams 30 or 31 respectively. This construction does not require any biasing springs as in the first embodiment because the journal 15 is held in a fixed position in the machine frame F and that fixed position has a fixed distance from the rotational axis 28A of the drive shaft 28 so that the only motion that the bellcrank lever 16B can perform is a tilting motion clockwise and counterclockwise with the roller 17 and 29 constantly in contact with their respective control cam surfaces. Otherwise, the embodiment of FIG. 3 functions in the same manner as the embodiment of FIGS. 1 and 2.

Although the invention has been described with reference to specific example embodiments, it will be appreciated that it is intended to cover all modifications and equivalents within the scope of the appended claims.

What is claimed is:

1. A weft clamp controller for a weft gripper in a shuttleless loom with a sley (1) carrying a reed (3) and a sley shaft (4) connected to said sley for performing a beat-up motion, said weft clamp controller comprising a weft clamp operating finger (10), a drive cam (18; 30, 31) for operating said finger (10), a coupling link (13) having a first end connected to said finger (10), said coupling link having a second end cooperating with said drive cam (18; 30, 31), a rocking guide arm (24) for said coupling link (13), a first pivot (23) connecting said guide arm (24) to said coupling link (13) below said finger (10), a second pivot (25) connecting said guide arm (24) to said sley (1) for movement with said sley (1), at least one cam follower roller (17), a first journal (14) rotatably securing said cam follower roller (17) to said second end of said coupling link (13) for a direct engagement of said cam follower roller (17) at said second end of said coupling link (13) with said drive cam (18; 30, 31), an urging mechanism (16, 20 or 16B, 29) connected to said first journal for constantly urging said cam follower roller (17) into engagement with said drive cam (18; 30, 31), and a drive shaft (28) for driving said drive cam (18; 30, 31) in synchronism with said sley shaft (4).

2. The weft clamp controller of claim 1, wherein said urging mechanism comprises a roller guide lever (16) pivoted by said first journal (14) to said cam follower roller (17) and to said second end of said coupling link (13), a second journal (15) for pivoting said roller guide lever (16) to said loom (F), and at least one spring (20 or 21) positioned for urging said cam follower roller (17) against said drive cam (18; 30, 31).

3. The weft clamp controller of claim 2, wherein said at least one spring (20) comprises a tension spring having one spring end connected to said first journal (14), said urging mechanism further comprising a telescoping guide (19A, 19B) for said at least one spring (20), said at least one spring (20) having another spring end connected to said telescoping guide, said urging mechanism further comprising a third journal including a roller (20A) connected to said telescoping guide (19A, 19B) for engaging said drive cam (18).

4. The weft clamp controller of claim 3, wherein said at least one spring is positioned in said telescoping guide and exerts a force component that extends in a direction substantially coinciding with a longitudinal axis of said coupling link (13).

5. The weft clamp controller of claim 2, wherein said at least one spring comprises a leaf spring (21) having one end adapted to be mounted to said loom (F) and a free end exerting a force on said cam follower roller (17) to keep said cam follower roller engaged with said drive cam (18).

6. The weft clamp controller of claim 5, wherein said at least one spring comprises a leaf spring packet.

7. The weft clamp controller of claim 2, wherein said single journal (14) is positioned outside a plane through which a longitudinal central axis (5) of said slay shaft (4) extends and through which a longitudinal central axis (28A) of said cam drive shaft (28) extends, said longitudinal axes (5, 28A) extending in parallel to each other in said plane.

8. The weft clamp controller of claim 1, wherein said urging mechanism comprises a bellcrank lever (16B) having a first lever arm (16C) and a second lever arm (16D), a second journal (15) for pivoting said bellcrank lever to said loom (F), said first journal (14) pivoting said cam follower roller (17) to said first lever arm (16C), and to said second end of said coupling link (13), a further cam follower roller (29) pivoted to said second lever arm (16D) of said bellcrank lever, said drive cam (30, 31) engaging said cam follower roller (17) and said further cam follower roller (29), whereby said bellcrank lever urges both rollers (17, 29) into engagement with said drive cam (30, 31).

9. The weft clamp controller of claim 8, wherein said drive cam (30, 31) comprises two separate cam curves (30A, 31A) so that said cam follower roller (17) engages one cam curve (30A) and the further cam follower roller (29) engages the other cam curve (31A).

10. The weft clamp controller of claim 8, wherein said cam drive shaft (28) drives said cam (30, 31) continuously when said loom is weaving, and wherein said cam drive shaft is adapted to be driven by a main loom drive in synchronism with a drive of said sley shaft (4).

11. The weft clamp controller of claim 8, wherein said second journal (15) has a fixed pivot axis positioned at a defined spacing from a central longitudinal axis (28A) of said cam drive shaft (28).

12. The weft clamp controller of claim 11, wherein said central longitudinal axis (28A) of said cam drive shaft (28) is located vertically below a central longitudinal axis (5) of said sley shaft (4), and both of said central longitudinal axes (5, 28A) extend in parallel to each other.

* * * * *